US007971297B2

(12) United States Patent
Masson

(10) Patent No.: US 7,971,297 B2
(45) Date of Patent: Jul. 5, 2011

(54) SLIDABLE CUSHION FOR A MULTI-PURPOSE GURNEY

(76) Inventor: Marcos V. Masson, Houston, TX (US)

( * ) Notice: Subject to any disclaimer, the term of this patent is extended or adjusted under 35 U.S.C. 154(b) by 168 days.

(21) Appl. No.: 12/486,148

(22) Filed: Jun. 17, 2009

(65) Prior Publication Data

US 2010/0319130 A1 Dec. 23, 2010

(51) Int. Cl.
*A47B 7/00* (2006.01)

(52) U.S. Cl. ..... 5/618; 5/610; 5/613; 5/722; 5/723

(58) Field of Classification Search ..... 5/613, 610, 5/608, 691, 722, 723; 297/63, 68, 219.1
See application file for complete search history.

(56) References Cited

U.S. PATENT DOCUMENTS

| | | | | |
|---|---|---|---|---|
| 503,969 | A | 8/1893 | Huddleston | |
| 2,101,290 | A | 12/1936 | Pierson | |
| 2,377,649 | A * | 6/1945 | Quinney | 297/68 |
| 2,609,862 | A | 9/1952 | Pratt | |
| 3,393,004 | A | 7/1968 | Williams | |
| 3,579,671 | A | 5/1971 | Koetter | |
| 3,739,406 | A | 6/1973 | Koetter | |
| 4,084,274 | A | 4/1978 | Willis et al. | |
| 4,658,450 | A | 4/1987 | Thompson | |
| 4,847,929 | A * | 7/1989 | Pupovic | 5/608 |
| 4,894,876 | A * | 1/1990 | Fenwick | 5/602 |
| 4,939,801 | A | 7/1990 | Schaal et al. | |
| 5,111,541 | A | 5/1992 | Wagner | |
| 5,275,176 | A | 1/1994 | Chandler | |
| 5,682,631 | A | 11/1997 | Weismiller et al. | |
| 5,926,876 | A | 7/1999 | Haigh et al. | |
| 6,336,235 | B1 | 1/2002 | Ruehl | |
| 6,804,846 | B2 | 10/2004 | Schuerch | |
| 7,213,279 | B2 | 5/2007 | Weismiller et al. | |
| 7,730,565 | B1 * | 6/2010 | Masson | 5/646 |
| 2004/0227331 | A1 * | 11/2004 | Chen et al. | 280/650 |
| 2010/0017964 | A1 * | 1/2010 | Kruse | 5/604 |

* cited by examiner

*Primary Examiner* — Robert G Santos
*Assistant Examiner* — Brittany M Wilson
(74) *Attorney, Agent, or Firm* — Egbert Law Offices PLLC

(57) ABSTRACT

An apparatus has a back section, a center section pivotally connected to the back section so that the back section is movable between a first position coplanar with the center section and a second position approximately perpendicular upwardly relative to the center section, a leg section pivotally connected to the center section so that the leg section is movable between a straight position coplanar with the center section and a bent position approximately perpendicular downwardly relative to the center section, a cushion slidably positioned on the center section so that the cushion is movable between a backward position and a forward position, and a sliding mechanism for sliding the cushion between the backward position and the forward position.

7 Claims, 3 Drawing Sheets

SLIDABLE CUSHION FOR A MULTI-PURPOSE GURNEY

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to multi-purpose gurneys. Particularly, the present invention relates to foldable sections of a multi-purpose gurney. More particularly, the present invention relates to cushions on each of the foldable sections of a multi-purpose gurney.

2. Description of Related Art Including Information Disclosed Under 37 CFR 1.97 and 37 CFR 1.98

Gurneys are often used in the hospital environment for patient support and transport. In particular, when a patient is taken to the operating room, the patient is placed upon a gurney and wheeled into the operating room. Once in the operating room, the patient is transferred from the gurney onto the surgical table so that the patient is in a proper position for surgery. The gurney is then removed from the operating room, or placed elsewhere, during the surgical procedure. Subsequent to surgery, the gurney is then returned to the operating room, the patient is placed upon the gurney, and then the patient is wheeled to other locations. The patient is also transferred from the gurney to a wheelchair when the patient leaves the hospital.

Unfortunately, the continual transfer of the patient from the gurney to the surgical table and from the gurney to the wheelchair, is inconvenient, time-consuming, tiresome and potentially injurious. Nurses, and other hospital personnel, often experience back pain, and other assorted injuries, during the transfer of the patient. Often, the patient must be physically lifted from the surgical table and placed upon the gurney and vice-versa. In other circumstances, the improper movement of the patient can adversely affect the surgical procedure or the results achieved from the surgery. As such, a need has developed whereby the gurney is actually used as the operating table and the wheelchair.

Various patents have issued relating to gurneys and operating tables. For example, U.S. Pat. No. 4,939,801, issued on Jun. 10, 1990 to Schuerch et al., teaches a patient transporting and turning gurney for receiving and lifting a patient from a hospital bed, for transporting and depositing the patient onto the hospital operating table, and for lifting and turning a patient for surgery. The gurney has a U-shaped base. This base is of sufficiently small dimension to fit under a hospital bed and of sufficiently large dimension to straddle the sides of the conventional operating table pedestal. The gurney further includes an overlying stretcher support for supporting a rotatable stretcher frame. A longitudinally extending rotating stretcher frame is mounted for rotation about its longitudinal axis on the stretcher support. There is provided a lifting device for moving the stretcher support upwardly and downwardly relative to the base.

U.S. Pat. No. 5,111,541, issued on May 12, 1992 to K. E. Wagner, describes a non-metallic gurney for patient transport. This gurney is formed of materials that are non-metallic, non-magnetic and of low electrical conductivity. This gurney is particularly used for modern non-invasive body scanning equipment.

U.S. Pat. No. 5,275,176, issued on Jan. 4, 1994 to Chandler, describes a surgical operating table particularly adapted for shoulder arthroscopy. The table includes a central seat support, a leg support, and a back support modified to include detachable modular shoulder cut-out to gain access to the posterior aspect of the shoulder. The leg support and back support are hingedly connected to the seat support for positioning the patient in a seating posture by operating mechanical crank arms. The patient is first supported in a supine position, anaesthetized, secured to the table, and the table is thereafter configured to a sitting position. One of the modular shoulder cut-outs is then removed to provide access to the shoulder on which arthroscopy is to be performed.

U.S. Pat. No. 3,739,406, issued on Jun. 19, 1973 to Koetter, discloses an adjustable bed particularly for use in hospitals and nursing homes for which a chassis is provided with at least one telescopically expandable pan, a bed frame tiltable relative to the chassis, at least one lifting assembly being disposed on the chassis, and at least one foot for each extendable part of the span. The bed frame has a middle portion and two end portions hinged to the middle portion. At least one lifting assembly is disposed at each end of the middle portion of the bed frame for adjusting the bed frame to various elevated and inclined positions.

U.S. Pat. No. 6,804,846, issued on Oct. 19, 2004 to Schuerch, discloses an adjustable position shoulder arthroscopy chair for surgical operating tables consisting of a back supporting platform pivotally attachable to the end of the table and an externally powered position actuator mounted at the base of the platform nearest the table and pivotally mounted to the platform at a location spaced apart from the base. The actuator is extendable and retractable and may be powered either electrically, hydraulically, or by compressed air. The extension and retraction of the actuator is controlled by a suitable device within the actuator or remote from it.

U.S. Pat. No. 5,926,876, issued on Jul. 27, 1999 to Haigh et al., discloses a device for adapting a surgical operating table such that the upper torso of the patient can be raised in order to place the patient in a seated position, the device further providing the means of exposing or supporting a side of the patient's upper torso and limbs. The device contains a continuously adjustable positioning mechanism, and corresponding actuator for the mechanism, in a way that a user can rapidly and conveniently put a patient in the desired position, from a supine posture to a fully seated position. Additionally, the device does not render the surgical table permanently modified, as the process of modification is reversible by means of a simple attachment mechanism. The device uses a back support section hingedly connected to a base frame, this base frame providing the attachment support to the surgical table. Side support panels are either moved out of the way on the patient's operative side, or left in place to provide support to the unaffected side. Two embodiments are described that differ solely in the way the back support surface is implemented.

U.S. Pat. No. 4,658,450, issued on Apr. 21, 1987 to Thompson, discloses a multi-position bed for use in hospitals. The bed has a base frame supported on casters and having a pair of pivoted angled lifting arms. One lifting arm is pivoted in turn to an interlink pivoted to a pivot bracket. Another lifting arm is pivoted directly to a second pivot. Pivot brackets act as the pivot supports for the center section of a mattress platform which also comprises two side sections. The side sections are not hinged directly to the center section but simply have inter-engaging features in the form of side frame registers. When the bed is used as a turning bed the inter-engaging features disengage. The side sections are carried by pairs of links which join the pivot brackets to the side sections at points underneath the side sections. These side sections are also connected by side frame pivot arms to an end pivot frame at each end of the bed. The pivot frame is rigidly connected to the center bed section. The movement of the bottom links is restricted in a downward direction by bottom link stops. The links may be disconnected and the side sections connected rigidly to the center section so that the mattress platform can be caused to tilt bodily in a lateral sense.

U.S. Pat. No. 4,084,274, issued on Apr. 18, 1978 to Willis et al., discloses a turning bed which can be tilted mechanically to turn the occupant from side to side, comprising a tilting assembly pivotally secured to a bed frame of known type. The tilting assembly consists of a mattress frame longitudinally divided into at least three parts: a center section with an outer section pivotally connected adjacent each longitudinal side of the center section. The pivotal connection is such that when the center section is tilted, the outer section adjacent the raised side of the center section is tilted as one with the center section, and the outer section adjacent the other side of the center section pivot relative thereto. The center section is pivotally supportable from the bed frame, and can be tilted by a lever secured at one end to the center section, the other end of the lever being moveable (by suitable means such as a screw-and-nut arrangement) to tilt the center section.

U.S. Pat. No. 3,579,671, issued on May 25, 1971 to Koetter, discloses an adjustable bed that has a chassis, a bed frame disposed on the chassis, two or three hydraulic cylinder piston units disposed at the ends of the bed, an articulated connection between the cylinder and the piston unit and the bed frame so that the bed frame may be moved to various elevated and/or inclined positions.

U.S. Pat. No. 2,609,862, issued on Sep. 9, 1952 to Pratt, discloses a hospital chair with a base, a frame having three section, and a mechanical lifter that adjusts the height of the chair up and down. The sections of the chair fold up and down to change the chair position to a flat position. The height and positions of the sections are adjusted manually.

U.S. Pat. No. 2,377,649, issued on Jun. 5, 1945 to Quinney, discloses a convertible chair that converts from a chair position to a bed position. Various mechanical ratchets and spools accomplish the objective of changing positions of the chair. The chair has a frame with three sections. The ends of the frame have legs for supporting the sections on the floor. The position of the convertible chair is adjusted manually.

U.S. Pat. No. 3,393,004, issued on Jul. 16, 1968 to Williams, discloses a hydraulic lift system for wheeled stretchers. The system has a lift mechanism that permits the direct placement of the patient-supporting in end-wise tilt in either direction from any previous position. The lift mechanism has a hydraulic lift cylinder, a positive-displacement pump connected to the hydraulic lift cylinder, a mechanism for operating pumps in unison, a reservoir connected to the pumps, a relief valve positioned between the hydraulic lift cylinder and the reservoir, and a hand-operated valve in fluid communication with the hydraulic lift cylinder.

U.S. Pat. No. 2,101,290, issued on Dec. 18, 1936 to Pierson, discloses an invalid chair with a frame having four sections and a base with wheels. The position of the sections is manually adjusted to change the position of the chair from a chair position to a bed position. The base of the chair is of a fixed height.

U.S. Pat. No. 503,969, issued on Aug. 29, 1893 to Huddleston, discloses a corpse dressing table with a movable head section. The head section moves upward relative to the rest of the table so as to position the torso of a corpse at an angle relative to the legs. The table can be folded upon itself for storage and transportation.

U.S. patent application Ser. No. 11/139,946, filed on May 31, 2005 by the present inventor, discloses a gurney for use in arthroscopic surgery that has a base and a frame positioned above the base. The frame has a plurality of deck sections pivotally connected together. One of the deck sections is a torso support section and has a plurality of panels connected together. At least one of the panels is separable from the other panels. The height of the frame above the base can be suitably adjusted by the use of first and second rams which are connected to one of the deck sections. The pivotability of the deck sections and the height-adjusting mechanism allow the gurney to assume a variety of positions.

These prior art multi-purpose gurneys having movable sections that are pivotally connected to one another. The sections of these multi-purpose gurneys have cushions placed thereon so as to firmly and delicately support the patient for the various functions of the multi-purpose gurney. The sections of the multi-purpose gurney are typically moveable so as to position a patient in a flat position, a chair position, and various other positions.

A problem associated with prior art multi-purpose gurneys is that the cushions crumple together when the sections are pivoted relative to one another. For example, the cushion that support the back of a patient crumples with the cushion that supports the buttocks of a patient when the multi-purpose gurney is moved from a flat position to a chair position. The crumpling of the cushions deforms the cushions and decreases the useful life of the cushions. Additionally, the cushion that supports the legs of a patient separates from the cushion that support the buttocks of a patient so as to form a gap between the cushions. The gap subjects the legs of a patient to the hard framework and any mechanisms of the multi-purpose gurney located below the cushions. Thus, there is a need to prevent the crumpling of cushions and to minimize any gaps formed between the cushions.

Various patents have issued relating to moveable cushions used on hospital beds, such as multi-purpose gurneys. For example, U.S. Pat. No. 7,213,279, issued on May 8, 2007 to Weismiller et al., discloses a bed having a frame, a deck, and a siderail. The deck has a head section, seat section, and foot sections. The head, seat, and foot sections are movable relative to one another. A cushion on the seat section moves with the seat section.

U.S. Pat. No. 6,336,235, issued on Jan. 8, 2002 to Ruehl, discloses a patient support apparatus that has a base and a patient support platform. The patient support platform has a head portion and a seat portion. The patient support apparatus has links configured to coordinate movement of the head portion of the patient support platform relative to the seat portion of the patient support platform. The cushion of the seat portion moves forward with the seat portion.

U.S. Pat. No. 5,682,631, issued on Nov. 4, 1997 to Weismiller et al., discloses bed a having a head end, a foot end, and sides. The bed has a frame and a deck carried by the frame. The deck has an upper deck portion and a central, longitudinal recess in the upper deck portion. The recess is defined by a lower deck portion and walls connecting the lower and the upper deck portions. The bed also includes a mattress that has a planar, upwardly-facing patient surface, side portions resting on the side deck portions, and a central projection extending downwardly into the recess. A first longitudinal deck section is coupled to the deck to pivot about a pivot axis above the lower deck portion between a generally horizontal position and a tilted position.

It is an object of the present invention to prevent crumpling of cushions of a multi-purpose gurney.

It is another object of the present invention to minimize any gaps between cushions that are created when moving sections of a multi-purpose gurney.

It is another object of the present invention to move sections of a multi-purpose gurney between a flat position and a chair position.

It is another object of the present invention to adapt to be used with a pedestal of a typical hospital bed.

It is still another object of the present invention to prevent exposure of a patient to the frame and any mechanism of a multi-purpose gurney.

It is another object of the present invention to position extremities of a patient when the patient is in a beach-chair or lateral-decubitus position.

These and other objects and advantages of the present invention will become apparent from a reading of the attached specification and appended claims.

BRIEF SUMMARY OF THE INVENTION

The present invention is an apparatus comprising a back section, a center section pivotally connected to the back section so that the back section is movable between a first position coplanar with the center section and a second position approximately perpendicular upwardly relative to the center section, a leg section pivotally connected to the center section so that the leg section is movable between a straight position coplanar with the center section and a bent position approximately perpendicular downwardly relative to the center section, a cushion slidably positioned on the center section so that the cushion is movable between a backward position and a forward position, and a sliding means for sliding the cushion between the backward position and the forward position.

A hinge is positioned between the back section and the center section. In one embodiment, the sliding means comprises a cam positioned adjacent the hinge, and a pin connected to the cushion. The cam engages the pin when the back section moves from the first position to the second position. The cushion moves from the backward position to the forward position when the back section moves from the first position to the second position. In another embodiment, the sliding means comprises a cam positioned adjacent the hinge, and a slot connected to the cushion. The cam engages the slot when the back section moves from the first position to the second position. The cushion moves from the backward position to the forward position when the back section moves from the first position to the second position.

A hinge is positioned between the leg section and the center section. In another embodiment, the sliding means comprises a cam positioned adjacent the hinge, and a pin connected to the cushion. The cam engages the pin when the leg section moves from the bent position to the straight position. The cushion moves from the forward position to the backward position when the leg section moves from the bent position to the straight position. In another embodiment, the sliding means comprises a cam positioned adjacent the hinge, and a slot connected to the cushion. The cam engages the slot when the leg section moves from the bent position to the straight position. The cushion moves from the forward position to the backward position when the leg section moves from the bent position to the straight position.

A back cushion is positioned on the back section, and a leg cushion is positioned on the leg section. The leg cushion has a side adjacent a bottom of the center cushion when the center cushion is in the forward position.

The present invention is a method for sliding a cushion positioned on a center section of a multi-purpose gurney comprising the steps of advancing a leg section of the multi-purpose gurney from a straight position coplanar with the center section to a bent position approximately perpendicular downwardly relative to the center section, moving a back section of the multi-purpose gurney from a first position coplanar with the center section to a second position approximately perpendicular upwardly relative to the center section, actuating a sliding means for sliding the cushion between a backward position and a forward position, and sliding the cushion from the backward position to the forward position.

The step of actuating can comprise contacting a pin connected to the cushion with a cam, and contacting another pin connected to the cushion with another cam. The method further comprises translating the cushion from the forward position to the backward position, moving the back section from the second position to the first position, and advancing the leg section from the bent position to the straight position.

The step of actuating can also comprise contacting a slot connected to the cushion with a cam, and contacting another slot connected to the cushion with another cam. The method further comprises translating the cushion from the forward position to the backward position, moving the back section from the second position to the first position, and advancing the leg section from the bent position to the straight position.

DETAILED DESCRIPTION OF THE INVENTION

Figure 1:
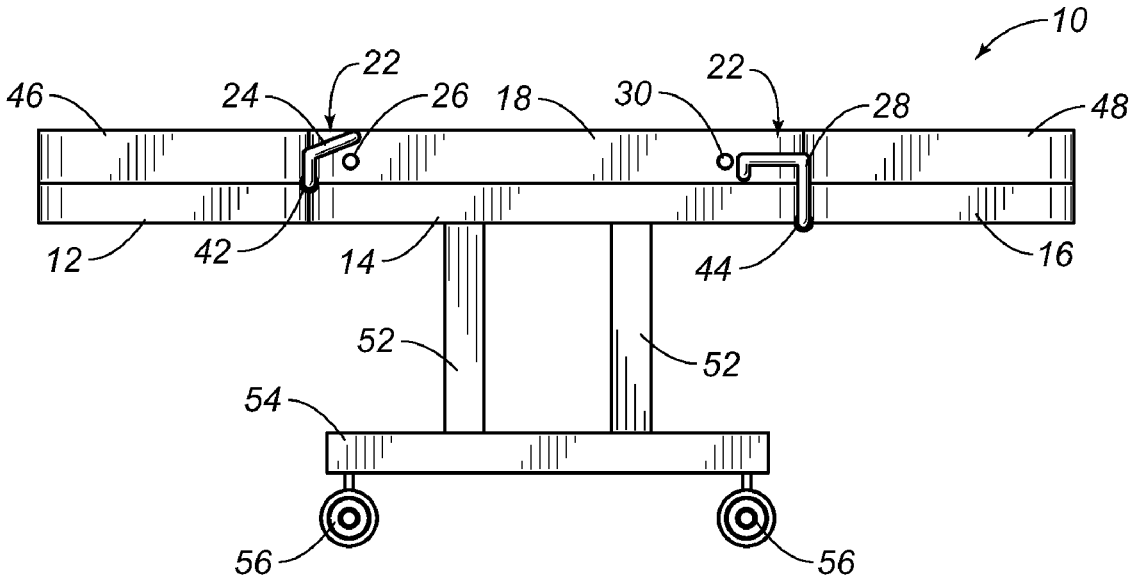
FIG. 1 shows a side elevational view of a preferred embodiment of the apparatus, with the cushion in the backward position.

Referring to FIG. 1, there is shown a side elevational view of the preferred embodiment of the apparatus 10. The apparatus 10 has a center section 14, a back section 12 pivotally connected to the center section 14, and a leg section 16 pivotally connected to the center section 14. The back section 12 is movable between a first position coplanar with the center section 14 and a second position approximately perpendicular upwardly relative to the center section 14. The back section 12 is shown in the first position in FIG. 1. The leg section 16 is movable between a straight position coplanar with the center section 14 and a bent position approximately perpendicular downwardly relative to the center section 14. The leg section 16 is shown in the straight position in FIG. 1. A cushion 18 is slidably positioned on the center section 14 so as to move between a backward position and a forward position. The cushion 18 in FIG. 1 is shown in the backward position. A back cushion 46 is positioned on the back section 12, and a leg cushion 48 is positioned on the leg section 16. A hinge 42 connects the back section 12 to the center section 14. A hinge 44 connects the center section 14 to the leg section 16. Hinge 42 allows the back section 12 to pivot relative to the center section 14. Hinge 44 allows the leg section 16 to pivot relative to the center section 14.

The apparatus 10 has a sliding means 22. In FIG. 1, the sliding means 22 has a cam 24 connected to the hinge 42 and a cam 28 connected to the hinge 44. A pin 26 and a pin 30 are connected to a side of the cushion 18. The pins 26 and 30 protrude from the side of the cushion 18. Cam 24 is specially formed to engage the pin 26 when the back section 12 moves from the first position to the second position. Cam 28 is specially formed to engage the pin 30 when the leg section 16 from the bent position to the straight position.

The apparatus 10 can be a part of a multi-purpose gurney that has a pedestal 52 connected to the center section 14, a base 54 connected to an end of the pedestal 52 opposite the center section 14, and wheels 56 connected to the base 54.

Figure 2:
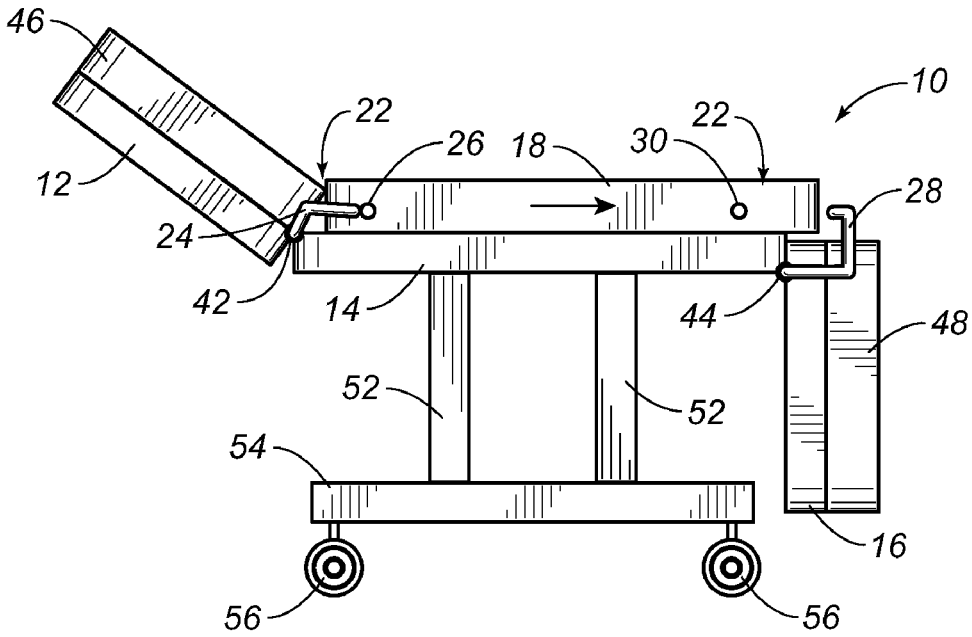
FIG. 2 shows a side elevational view of the apparatus, with the back section pivoted relative to the center section so as to slide the cushion from a backward position to a forward position.

Referring to FIG. 2, there is shown a side elevational view of the apparatus 10, with the back section 12 pivoted relative to the center section 14 so as to slide the cushion 18 from the backward position to the forward position. The back section 12 is shown in an intermediate position between the first position and the second position. The leg section 16 is shown in the bent position. The cam 24 of the sliding means 22 has moved with the movement of the back section 12 so that the cam 24 engages the pin 26 of the sliding means. The cam 28 of sliding means 22 has moved with the movement of the leg section 16 so that the cam 28 of the sliding means 22 is clear of the movement of the cushion 18 and the pin 30 in the direction of the arrow shown in FIG. 2. The leg cushion 48 moves with the movement of the leg section 16. The back cushion 46 moves with the movement of the back section 12. The cam 24 of the sliding means 22 has engaged the pin 26 of the sliding means 22 so as to urge the cushion 18 to the forward position in the direction of the arrow shown in FIG. 2. In FIG. 2, it can be seen that cam 24 has two portions that are in angled relation with one another. The cam 28 has several portion angled with respect to the respective adjacent proportion. The cams 24 and 28 can be formed of any number of portions and at any angled relationship so as to suitably engage pins 28 and 30, respectively.

Figure 3:
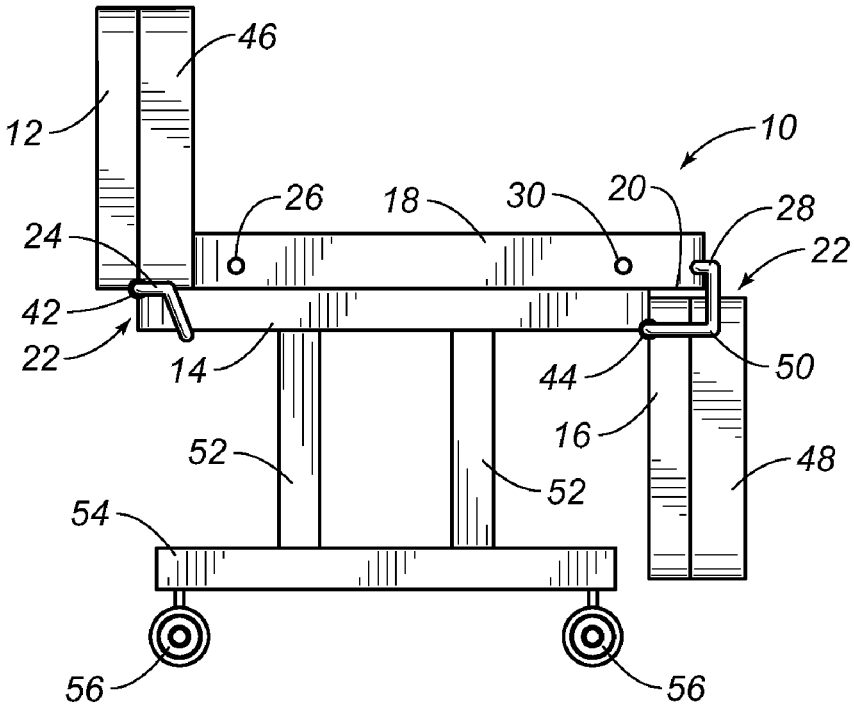
FIG. 3 shows a side elevational view of the apparatus, with the cushion in the forward position.

Referring to FIG. 3, there is shown a side elevational view of the apparatus 10, with the cushion 18 in the forward position. The back section 12 is shown in the second position that is approximately perpendicular upwardly relative to the center section 14. The leg section 16 is shown in the bent position that is approximately perpendicular downwardly relative to the center section 14. The cushion 18 is shown in the forward position. The cam 28 is connected to the hinge 44 so that it does not obstruct the position of a patient's legs. The cam 24 has moved with the movement of the back section 12 so that it no longer contacts the pin 26 of the sliding means. The cam 24 is adjacent the center section 14. The back cushion 46 is still adjacent the cushion 26, yet the cushions 46 and 26 are not crumpled together. Prior art cushion arrangements crumple the cushions when the back cushion and cushion move positions. The movement of cushion 18 to the forward position prevents the back cushion 46 from crumpling against the cushion 18. The cushion 18 moves so that the back cushion 46 can move to the space which cushion 18 previously occupied while in the backward position. The bottom 20 of cushion 18 is adjacent the side 50 of the leg cushion 48. Any gap between the cushion 18 and leg cushion 48 is minimized when the cushion 18 is in the forward position. The legs of a patient are thus minimally exposed, if at all, to the framework and mechanisms of a multi-purpose gurney that is below the center section 14.

Figure 4:
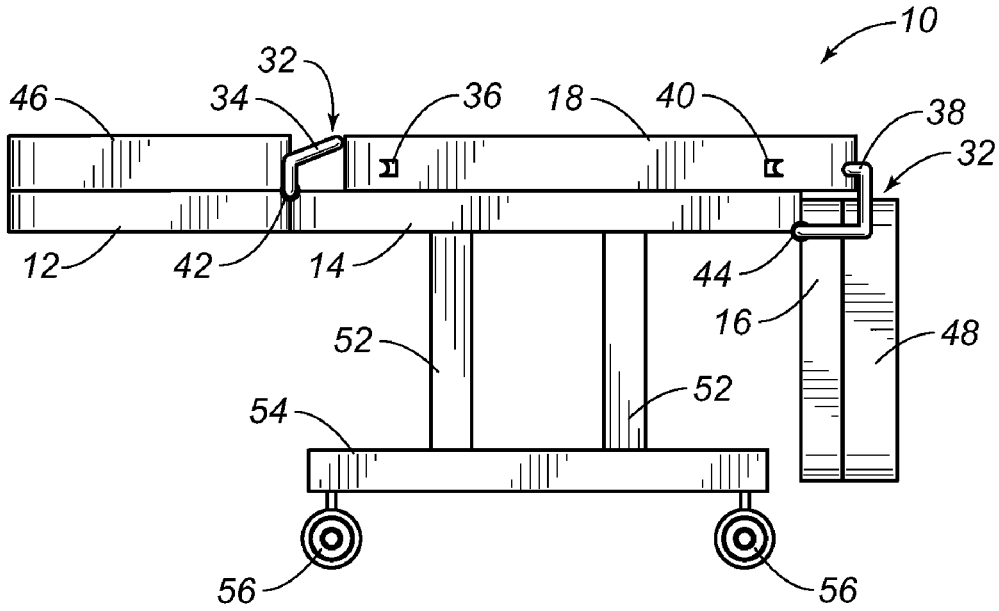
FIG. 4 shows a side elevational view of the apparatus, with the back section pivoted relative to the center section so as to allow the cushion to move from the forward position to the backward position.

Referring to FIG. 4, there is shown a side elevational view of the apparatus 10, with the back section 12 pivoted relative to the center section 14 so as to allow the cushion 18 to move from the forward position to the backward position. The apparatus 10 of FIG. 4 shows a modified sliding means 32. The sliding means 32 has a cam 34 connected to the hinge 42, and a cam 38 connected to the hinge 44. The sliding means 32 also has a slot 36 and a slot 40. The slots 36 and 40 are connected to the side of cushion 18. The slots 36 and 40 are shaped differently than the pins 26 and 30 described in FIGS. 1 through 3 above. The slots 36 and 40 allow the cams 34 and 38 to engage, respectively, so as to move the cushion 18 between the forward and backward positions. The cushion 18 remains in the forward position in FIG. 4 because cam 38 has not moved. The back section 12 has moved from the second position to the first position so that the back section 12 is coplanar with the center section 14. The cam 34 has moved with the movement of the back section 12. A gap is created between the cushion 46 and cushion 18, and this gap will be closed once the cushion 18 moves from the forward position to the backward position.

Figure 5:
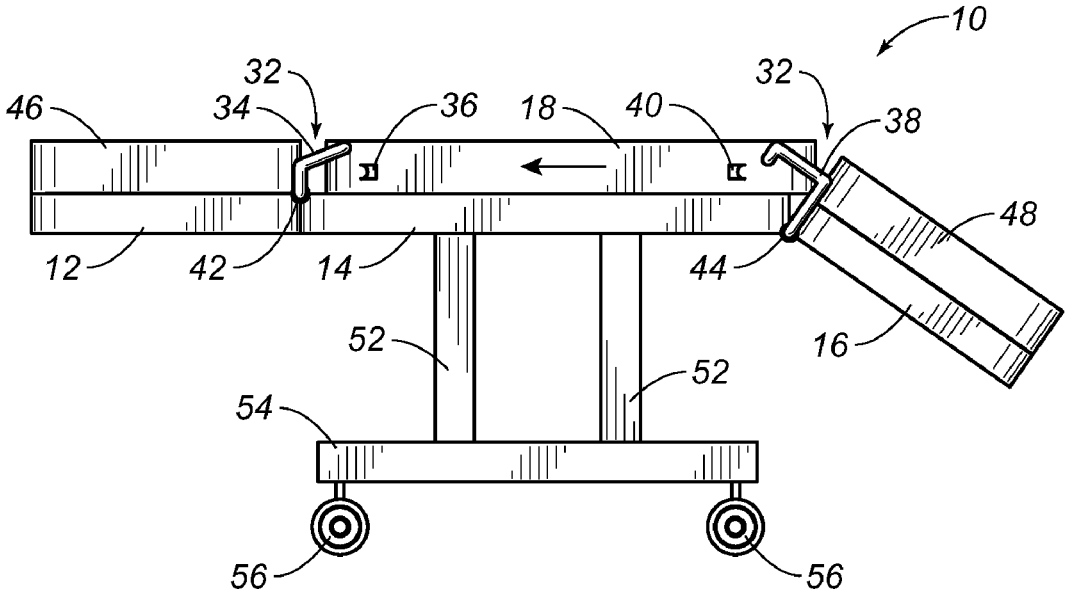
FIG. 5 shows a side elevational view of the apparatus, with the leg section pivoted relative to the center section so as to slide the cushion from the forward position to the backward position.

Referring to FIG. 5, there is shown a side elevational view of the apparatus 10, with the leg section 16 pivoted relative to the center section 12 so as to slide the cushion 18 from the forward position to the backward position. The leg section 16 is shown in an intermediate position between the bent position and the straight position. The cam 38 of the sliding means 32 has moved with the movement of the leg section 16. The cam 38 has engaged the slot 40 so as to move the cushion 18 in the direction of the arrow shown in FIG. 5, i.e. from the forward position to the backward position. The slot 40 has a surface that receives an end of the cam 38 when the cam 38 and slot 40 engage. Slot 36 has a similar surface that receives an end of the cam 34 when the cam 34 and slot 36 engage.

Figure 6:
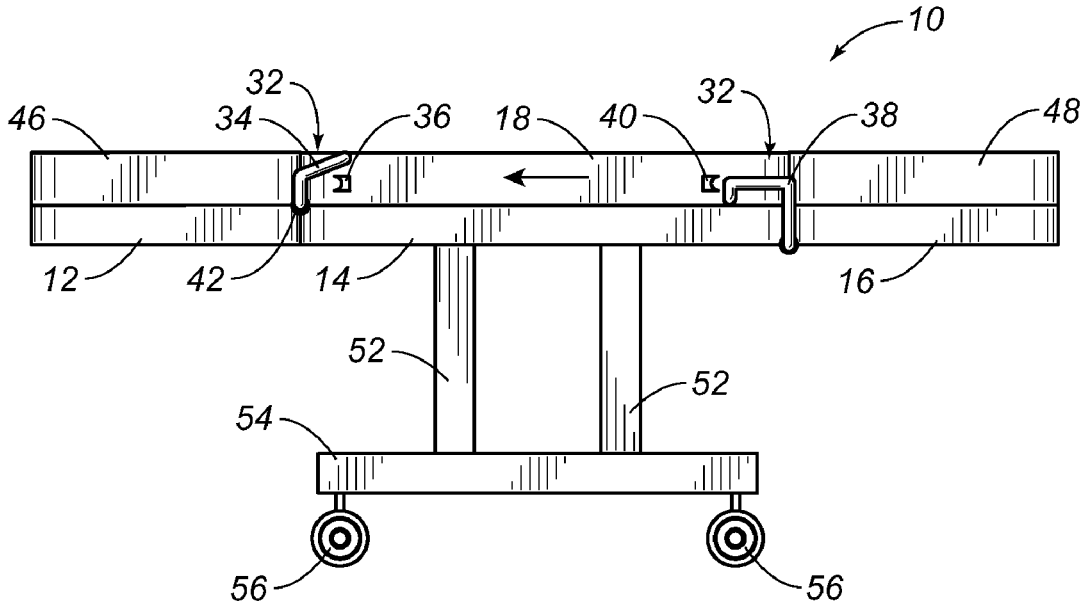
FIG. 6 shows a side elevational view of the apparatus, with the cushion in the backward position.

Referring to FIG. 6, there is shown a side elevational view of the apparatus 10, with the cushion 18 in the backward position. The leg section 16 has pivoted so that it is in the straight position and coplanar with the center section 14. The cam 38 of the sliding means 32 has moved with the movement of the leg section 16. The cams 34 and 38 are in the same position as cams 24 and 28 of FIG. 1. The sliding means 32 of FIGS. 4 through 6 is similar to the sliding means 22 of FIGS. 1 through 3. The pins 26 and 30 of sliding means 22 perform an equivalent function to the slots 36 and 40 of sliding means 32. The back section 12 of the apparatus 10 is shown in the first position. The sliding means 32 has operated so as to move the cushion 18 to the backward position so that the apparatus 10 is ready for moving the cushion 18 to the forward position when desired.

The cushions 46, 18, and 48 have the same thickness. Preferably, the cushions 46, 18, and 48 have a thickness of four inches. The shortcoming of prior art are overcome by the apparatus 10 by the movement of cushion 18 which is facilitated by the sliding means that causes the movement of the cushion 18 between the forward and backward positions. The apparatus 10 can be used on hospital beds, gurneys, operating tables, multi-purpose gurneys, and any other such devices.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a back section;

a center section pivotally connected to said back section, said back section being movable between a first position coplanar with said center section and a second position approximately perpendicular upwardly relative to said center section;

a leg section pivotally connected to said center section, said leg section being movable between a straight position coplanar with said center section and a bent position approximately perpendicular downwardly relative to said center section;

a cushion slidably positioned on said center section, said cushion being movable between a backward position and a forward position;

a hinge positioned between said leg section and said center section; and a sliding means for sliding said cushion between said backward position and said forward position, said sliding means comprising:

a cam positioned adjacent said hinge; and a pin connected to said cushion, said cam suitable for engaging said pin when said leg section moves from said bent position to said straight position.

2. The apparatus of claim 1, said cushion suitable for moving from said backward position to said forward position when said back section moves from said first position to said second position.

3. The apparatus of claim 1, said cushion moving from said forward position to said backward position when said leg section moves from said bent position to said straight position.

4. An apparatus comprising:

a back section;

a center section pivotally connected to said back section, said back section being movable between a first position coplanar with said center section and a second position approximately perpendicular upwardly relative to said center section;

a leg section pivotally connected to said center section, said leg section being movable between a straight position coplanar with said center section and a bent position approximately perpendicular downwardly relative to said center section;

a cushion slidably positioned on said center section, said cushion being movable between a backward position and a forward position;

a hinge positioned between said leg section and said center section; and a sliding means for sliding said cushion between said backward position and said forward position, said sliding means comprising:

a cam positioned adjacent said hinge; and a slot connected to said cushion, said cam suitable for engaging said slot when said leg section moves from said bent position to said straight position.

5. The apparatus of claim 4, said cushion moving from said forward position to said backward position when said leg section moves from said bent position to said straight position.

6. The apparatus of claim 4, further comprising:

a back cushion positioned on said back section; and a leg cushion positioned on said leg section.

7. The apparatus of claim 6, said leg cushion having a side adjacent a bottom of said cushion when said cushion is in said forward position.

* * * * *